US005564261A

United States Patent [19]

Kiner

[11] Patent Number: 5,564,261

[45] Date of Patent: Oct. 15, 1996

[54] METHOD AND APPARATUS FOR FEEDING RESILIENTLY COMPRESSED ARTICLES TO A FORM/FILL/SEAL MACHINE

[75] Inventor: Robert S. Kiner, Guilford, Ind.

[73] Assignee: The Procter & Gamble Company, Cincinnati, Ohio

[21] Appl. No.: 566,200

[22] Filed: Dec. 1, 1995

[51] Int. Cl.[6] ..... B65B 5/06; B65B 13/20; B65B 63/02

[52] U.S. Cl. ..... 53/439; 53/450; 53/529; 53/550

[58] Field of Search ..... 53/438, 439, 450, 53/451, 529, 530, 550, 551

[56] References Cited

U.S. PATENT DOCUMENTS

| | | | |
|---|---|---|---|
| 1,261,612 | 4/1918 | Powers . | |
| 1,920,841 | 8/1933 | Clark | 100/14 |
| 2,011,236 | 8/1935 | Winter et al. | 206/57 |
| 2,506,021 | 5/1950 | Holmerg . | |
| 2,693,304 | 11/1954 | Davis et al. | 226/18 |
| 3,059,387 | 10/1962 | Fasanella . | |
| 3,117,513 | 1/1964 | Burnett et al. | 100/215 |
| 3,274,746 | 9/1966 | James et al. . | |
| 3,319,394 | 5/1967 | Talalay et al. | 53/439 |
| 3,327,449 | 6/1967 | Hullhorst et al. . | |
| 3,513,628 | 5/1970 | Lee et al. . | |
| 3,626,656 | 12/1971 | Langenscheidt . | |
| 3,660,964 | 5/1972 | Willis et al. . | |
| 3,729,886 | 5/1973 | Lucas et al. . | |
| 3,792,564 | 2/1974 | Brady, Jr. . | |
| 3,818,673 | 6/1974 | Rollins et al. . | |
| 3,919,739 | 11/1975 | Kawai | 17/33 |
| 4,062,169 | 12/1977 | Lister et al. . | |
| 4,074,508 | 2/1978 | Reid . | |
| 4,182,237 | 1/1980 | O'Brien | 100/35 |
| 4,241,562 | 12/1980 | Meyer | 53/438 |
| 4,328,655 | 5/1982 | Spencer et al. | 53/439 |
| 4,501,107 | 2/1985 | Piotrowski | 53/438 |
| 4,577,453 | 3/1986 | Hofeler | 53/438 |
| 4,592,193 | 6/1986 | Gustavsson | 53/550 |
| 4,711,067 | 12/1987 | Magni | 53/439 |
| 4,722,168 | 2/1988 | Heaney | 53/450 |
| 4,761,937 | 8/1988 | Francioni | 53/550 |
| 4,817,365 | 4/1989 | Yawberg et al. | 53/438 |
| 5,022,216 | 6/1991 | Muckenfuhs et al. | 53/439 X |
| 5,177,935 | 1/1993 | Jones et al. | 53/439 X |
| 5,255,495 | 10/1993 | Kovacs | 53/550 X |
| 5,357,731 | 10/1994 | Conway et al. | 53/374.4 |
| 5,377,478 | 1/1995 | Kovacs et al. | 53/550 |

FOREIGN PATENT DOCUMENTS

| | | |
|---|---|---|
| 252875 | 7/1964 | Australia . |
| 1417082 | 12/1975 | Denmark . |

*Primary Examiner*—Horace M. Culver
*Attorney, Agent, or Firm*—Ronald W. Kock

[57] ABSTRACT

A method and apparatus for feeding resiliently compressed articles into a form/fill/seal machine. The method includes steps of receiving horizontally compressed articles into an infeed end of a pair of conveyor belts, continuously conveying the compressed articles to a discharge end, continuously forming a plastic film around the pair of cantilevered conveyor belts without the stack of articles exerting expansion force against the plastic film, forming and sealing a closed tube, and releasing the stack of compressed articles into the closed tube only after the seal has sufficient strength to maintain the stack of articles compressed. The pair of conveyor belts has rigid conveyor backing members and cantilevered ends with a discharge pulley mounted at each cantilevered end. At least one tie bar connects the backing members near the cantilevered ends in order to resist the expansion force of one or more stacks of resiliently compressed articles between the conveyor belts.

13 Claims, 4 Drawing Sheets

METHOD AND APPARATUS FOR FEEDING RESILIENTLY COMPRESSED ARTICLES TO A FORM/FILL/SEAL MACHINE

FIELD OF THE INVENTION

The present invention relates to form/fill/seal machines, and more particularly to such machines wherein articles are resiliently compressed when filled into a continuous plastic film tube. Even more particularly, the present invention relates to such machines and methods for filling wherein the process is a continuous motion process.

BACKGROUND OF THE INVENTION

Form/fill/seal machines are old in the art. However, the ability to use them for packaging resiliently compressible articles, such as diapers, in a compressed state has been a recent development. U.S. Pat. No. 4,592,193 to Gustavsson, for example, discloses an apparatus which compresses articles by means of a pair of converging belts above and below the articles. Compressed articles are indexed through a compression section and into a parallel conveyor section, which maintains the articles compressed by top and bottom belts and is cantilevered into a film tube forming system. A film tube forming system is located around the parallel conveyors. The film tube edges are brought together and sealed where they overlap. A drive connection between the film and the parallel conveyors is provided to advance the film when the conveyors index. At the discharge end of the parallel conveyor, a means for cross-sealing and cutting the film tube is provided. Immediately thereafter, a discharge conveyor is located. The purpose of the discharge conveyor section is to maintain the articles compressed after they are released into the film tube, which has a fresh overlap seal. The discharge conveyor section provides time for the seal to cool and gain sufficient strength to maintain the articles compressed. The system of Gustavsson is believed to be slow because the entire system indexes forward one article at a time. Also, Gustavsson requires a separate discharge conveyor section to regrip the compressed articles after they are released into the tubing.

U.S. Pat. No. 3,523,628 to Lee et al. discloses an article compressing apparatus for a stack of disposable diapers. Compression occurs between a pair of converging endless belts which discharge the stack into a holder, such as a pair of spaced jaws which hold the stack compressed as a paper sleeve wrapper is disposed about the stack to hold it in a compressed state. The stack of diapers is compressed to about one-half of its original thickness in a continuous process. In another reference.

U.S. Pat. No. 5,022,216 to Muckenfuhs et at., a method and apparatus are disclosed for transferring a compressed stack of diapers into a preformed bag. However, neither of these references deal with the problem of forming and sealing a continuous plastic film tube while a stack of articles is being loaded into it.

U.S. Pat. No. 4,722,168 to Heaney discloses a film tube forming and sealing system. A film tube is formed into a generally rectangular shape, having its two edge portions formed into downwardly extending fins. Finwheels grip the downwardly extending adjacent pair of film edge fins. The middle pair of finwheels is preferably heated to effect sealing of the edges together in a continuous longitudinal seal. However, as in most other form/fill/seal machines, the articles are not resiliently compressed, so that there is again no concern with forming and sealing a continuous plastic film tube while a stack of articles is being loaded into it.

OBJECTS OF THE INVENTION

It is an object of the present invention to receive stacks of resiliently compressed articles and to continuously form a plastic film tube and fill the tube with spaced-apart stacks of resiliently compressed articles at the highest possible speed.

It is a further object of the present invention to provide a simple apparatus, having only one conveyor section to complete the film forming operation, for releasing a stack of resiliently compressed articles into a continuous plastic film tube immediately after the tube is formed, without damaging the tube or its seal.

It is an additional object of the present invention to achieve the above objects when stacks of resilient articles are compressed under a force ranging from about 75 to about 200 pounds.

SUMMARY OF THE INVENTION

Pre-compressed resilient articles are received and conveyed into a continuously formed plastic film tube. The plastic film tube is fin sealed closed longitudinally around multiple, spaced-apart, stacks of resilient articles, while the stacks remain compressed by a conveyor system cantilevered into the sealed tube. The conveyor system does not release the compressed articles into the tube until after the fin seal has developed sufficient strength to maintain article compression. The articles resiliently expand in the film tube slightly after exiting the conveyor system to fill the void previously occupied by the cantilevered conveyor system.

A stack of resilient articles is defined herein as a plurality of articles placed side-by-side substantially perpendicular to the application of compression force. A stack of articles, as defined herein, may also include several rows of side-by-side articles, such that one row rests atop another or one row lies to the front of or rear of another row, as long as all the rows of a stack are either in contact with one another or close enough in proximity to each other that they may be packaged as one bundle.

In one aspect of the present invention, a method of feeding a stack of resiliently compressed articles into a plastic film tube comprises the step of receiving the stack of resiliently compressed articles into an infeed end of a pair of conveyor belts and continuously conveying the stack to a discharge end of the pair of conveyor belts. The pair of conveyors is oriented to convey the stack of resiliently compressed articles preferably horizontally compressed and under a force of about 75 to about 200 pounds. The stack is also maintained spaced apart from other stacks of resiliently compressed articles throughout the continuous conveying step. Such spacing enables sealing and cutting dies to later enter gaps between stacks within the tubing and seal the plastic tubing closed between the stacks and cut them apart to form individual packages for each of the stacks.

Meanwhile, a plastic film is progressively formed around the pair of conveyor belts to form a closed tube, wherein the stack of resiliently compressed articles exerts no expansion force on the closed tube while the stack of resiliently compressed articles is being conveyed by the pair of conveyor belts. In another step, the closed tube is continuously sealed to form a longitudinally sealed tube. Substantially parallel outwardly-facing edges are generated on the closed tube during the forming step, and they are fin sealed together. Finally, the method comprises the step of releasing the stack of resiliently compressed articles into the longitudinally sealed tube only after the sealing step is sufficiently complete to maintain the stack of resiliently compressed articles compressed in the longitudinally sealed tube. The stack of resiliently compressed articles expands to fill the space occupied by the conveyor belts when it is released. It expands to a dimension less than an un-compressed dimension since the stack is restrained by the longitudinally sealed tube, but greater than the pre-compressed dimension of the stacks.

In another aspect of the present invention, an apparatus for feeding a stack of resiliently compressed articles into a plastic film tube comprises a frame and a first infeed pulley supported from the frame. It also comprises a second infeed pulley supported from the frame. The second infeed pulley is substantially parallel to the first infeed pulley. A first backing member is connected to the frame which has a first cantilevered end and a first discharge pulley mounted to the first cantilevered end. A second backing member is connected to the frame which has a second cantilevered end and a second discharge pulley mounted to the second cantilevered end. The second discharge pulley is substantially parallel to the first discharge pulley.

The apparatus further comprises a first conveyor belt passing around the first infeed pulley and the first discharge pulley, and a second conveyor belt passing around the second infeed pulley and the second discharge pulley. The first backing member is supported within the first conveyor belt between the first infeed pulley and the first discharge pulley, and the second backing member is supported within the second conveyor belt between the second infeed pulley and the second discharge pulley. There is at least one tie bar connecting the first and second backing members near the first and second cantilevered ends to maintain the first and second backing members substantially parallel and rigid under the expansion force of one or more stacks of resiliently compressed articles. The first and second backing members are spaced apart such that the stack of resiliently compressed articles is maintained compressed between the first and second conveyor belts when the first and second conveyor belts are backed up by the first and second backing members.

A drive system drives at least one of the first and second conveyor belts such that the resiliently compressed articles are conveyed continuously from the first and second infeed pulleys to the first and second discharge pulleys. The first and second conveyor belts, the belt drive system, the first and second backing members, the first and second infeed and discharge pulleys, and the at least one tie bar define a compression isolating device.

The apparatus includes a plastic film unwind system and a film tube former for progressively forming a closed plastic film tube around the compression isolating device. The apparatus also includes a means for continuously drawing plastic film from the unwind system and sealing the closed plastic film tube to form a longitudinally sealed tube. The drawing and sealing means is located relative to the compression isolating device such that the stack of resiliently compressed articles is released from the compression isolating device into the longitudinally sealed tube only after the longitudinally sealed tube has sufficient strength to maintain the stack of resiliently compressed articles compressed.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
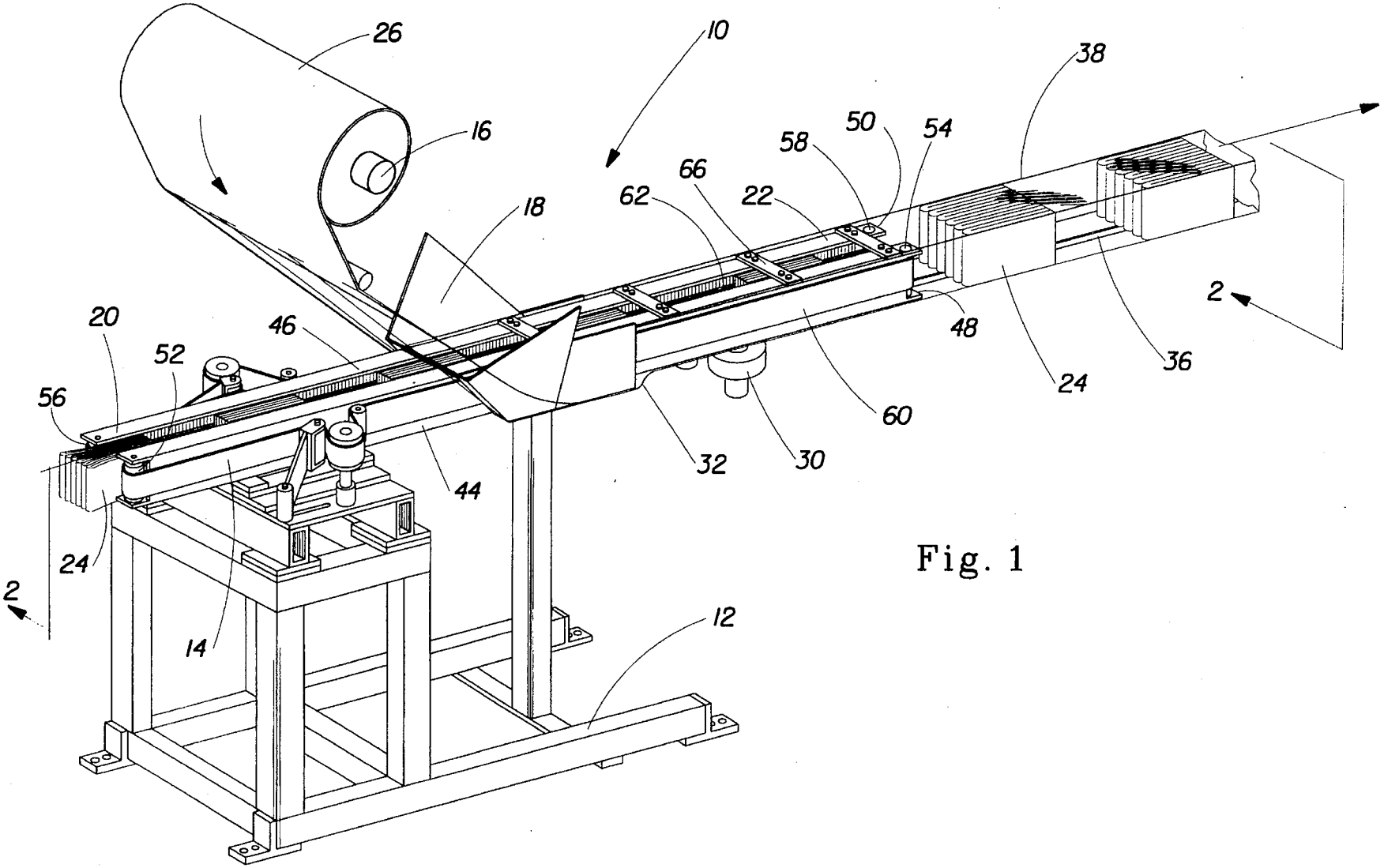
FIG. 1 is a perspective view of a preferred embodiment of the apparatus for feeding stacks of resiliently compressed articles to a tube forming section of the present invention, disclosing a pair of conveyor belts and a plastic film tube forming section.
Figure 2:
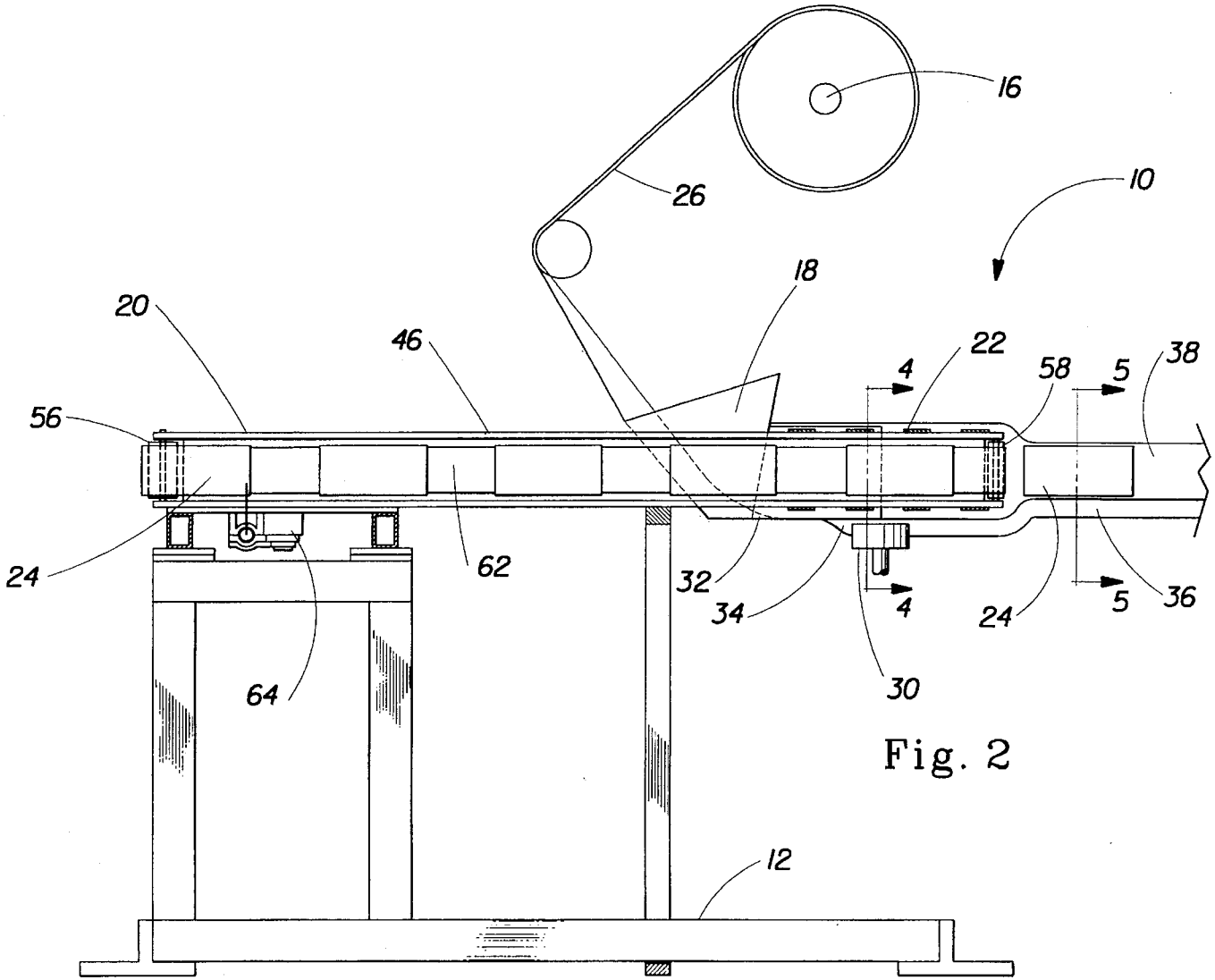
FIG. 2 is a sectioned side elevation view thereof, taken along section lines 2—2 of FIG. 1, showing a pair of conveyor belts cantilevered inside the film tube as it is formed.
Figure 3:
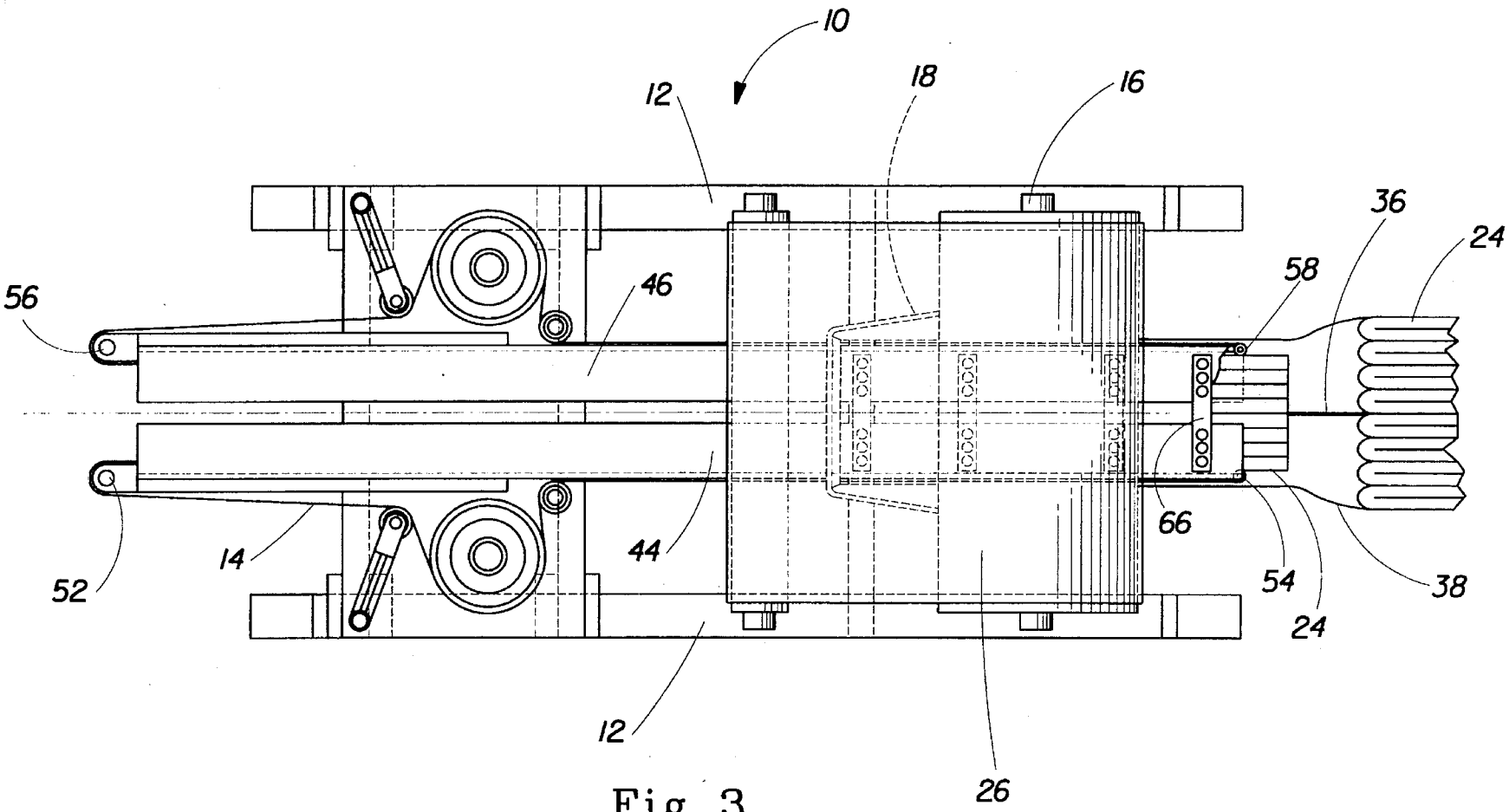
FIG. 3 is a partially sectioned top plan view thereof, disclosing the discharge end of the pair of conveyor belts.

Referring now to the drawings, and more particularly to FIGS. 1, 2, and 3, there is shown a preferred embodiment of the present invention, which provides a method and apparatus for feeding a stack of resiliently compressed articles into a form/fill/seal machine, and is generally indicated as 10. Apparatus 10 includes a frame 12, a pair of conveyor belts 14, a plastic film unwind system 16, and a film tube former 18. Pair of conveyor belts 14 comprises two substantially parallel side-by-side belts of substantially equal length, having an infeed end 20 and a discharge end 22.

A stack of resiliently compressed articles 24 is oriented along a horizontal axis and fed into infeed end 20 after having been pre-compressed to a compression force F of about 75 to about 200 pounds by a compressing means not shown. More preferably a compressing means over-compresses stack 24 and then releases the compression force such that compression force F results when stack 24 is received at infeed end 20. Pair of conveyor belts 14 conveys stack 24 from infeed end 20 to discharge end 22 in a continuous manner while maintaining force F substantially constant. There may be some relaxation of the compression force F, however, if the stack of articles is not perfectly resilient. The preferred stack of articles of the present invention is a stack of folded diapers.

Figure 4:
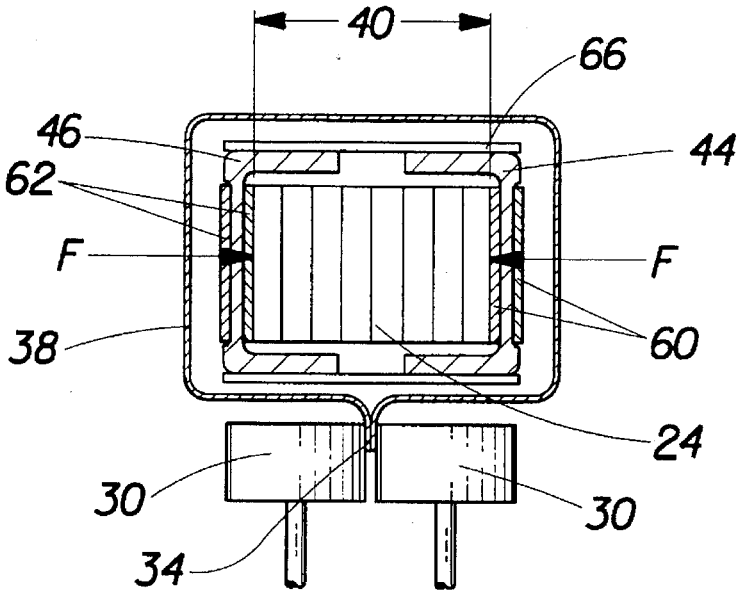
FIG. 4 is a sectioned rear elevation view thereof, taken along section lines 4—4 of FIG. 2, showing the construction of the pair of conveyor belts and their backing members.
Figure 5:
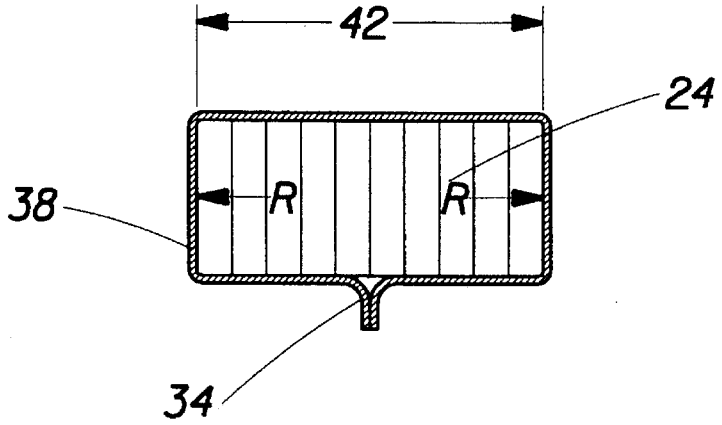
FIG. 5 is a sectioned rear elevation view thereof, taken along section lines 5—5 of FIG. 2, showing a stack of resilient articles released into the sealed plastic film tube.

Meanwhile, plastic film unwind system 16 continuously feeds a web of plastic film 26 to film tube former 18. Film tube former 18 preferably is a stationary folding board. At least one pair of sealing wheels 30 pull plastic film 26 from unwind system 16 and over the folding board to form a closed plastic film tube 32. Film tube former 18 folds plastic film 26 into a rectangular cross-section with edges 34 of the plastic film formed substantially parallel and facing outwardly from the rectangular cross-section. This rectangular cross-section and substantially parallel outwardly-facing edges 34 are best seen in FIG. 4.

Sealing wheels 30 grip edged 34 to both pull plastic film 26 and initiate a fin seal 36 between edges 34. Sealing wheels 30 are preferably heated to a temperature which sufficiently softens plastic film 26 at edges 34. Sealing wheels 30 also exert sufficient pressure to fuse together softened plastic film 26 at edges 34 to form a longitudinally sealed closed tube 38. Fin seal 36 may cool in air, or a pair of chill wheels may be located downstream from sealing wheels 30 to facilitate completion of the sealing process. Alternatively, three pair of wheels, each pair spaced downstream from the previous pair, may draw film 26, heat edges 34, and cool fin seal 36. At a film speed of 25 meters per minute, it has been found that fin seal 36 reaches its maximum strength about one second after cooling is initiated. During the seal curing time, it is essential that an expansion force R from stack of resilient articles 24 be isolated from longitudinally sealed tube 38. In this regard, the function of apparatus 10 includes serving as a compression isolating device.

Pair of conveyor belts 14 is cantilevered into sealed tube 38, and stack of resilient articles 24 is maintained horizontally compressed between the belts. Stack of resilient articles 24 is not released into longitudinally sealed tube 38 until fin seal 36 is completely cured to its full strength. Once stack of resilient articles 24 is released from discharge end 22 into sealed tube 38, expansion force R is applied to sealed tube 38, and fin seal 36 must be able to withstand that force. However, stack of resilient articles 24 has a dimension 40 when it is pre-compressed and conveyed by pair of conveyor belts 14. Dimension 40 is less than a dimension 42 of stack of resilient articles 24 when the stack is released into longitudinally sealed tube 38. That is, stack of resilient articles 24 expands when released to fill the sealed tube, which has a slightly larger dimension than the compression isolating device cantilevered into it.

Frame 12 is a floor-mounted frame, preferably made of tubular steel. Horizontally mounted to frame 12 are a first backing member 44 and a second backing member 46. Backing members 44 and 46 are parallel and partially cantilevered from frame 12 and have first cantilevered end 48 and second cantilevered end 50, respectively. First backing member 44 has a first infeed pulley 52 mounted at one end thereof and a first discharge pulley 54 mounted at first cantilevered end 48. Similarly, second backing member 46 has a second infeed pulley 56 mounted at one end and a second discharge pulley 58 mounted at second cantilevered end 50. Connected between first infeed pulley 52 and first discharge pulley 54 is a first conveyor belt 60, which surrounds first backing member 44. Connected between second infeed pulley 56 and second discharge pulley 58 is a second conveyor belt 62, which surrounds second backing member 46. Belts 60 and 62 form pair of conveyor belts 14. At least one drive motor and speed control system 64, not shown, is mounted to frame 10 to drive at least one of the belts 60 and 62.

First and second backing members 44 and 46 are channel-shaped members having flanges which face each other. There is some space between backing members 44 and 46 so that belts 60 and 62 can be installed over them. Across the top and bottom flange of each backing member channel is connected at least one tie bar 66, which holds the channels together under the compression forces of stacks of resilient articles passing between belts 60 and 62. Belt tensioners and drive pulleys cause belts 60 and 62 to be taut at all times when running. Drive and tensioning pulleys are mounted from frame 10 to cause taut belts 60 and 62 to ride against backing members 44 and 46 along the total lengths of the sides of the backing members which face each other and along the opposite sides where the backing members are cantilevered. This arrangement of backing members and belts and tie bars forms a rectangular tube compression isolating device. Tie bars are preferably recessed into channel flanges to minimize the cross-section of the compression isolating device.

Mounted from and above frame 12 is plastic film unwind system 16. Mounted from frame 12 closely surrounding the rectangular tube compression isolating device formed by backing members 44 and 46 and belts 60 and 62 and tie bars 66 is film tube former 18, which is preferably a conventional folding board. Thus, plastic film is drawn from unwind system 16 and drawn around tube former 18 to form closed plastic film tube 32, which has a rectangular cross-section just outside that of the compression isolating device.

A key advantage of the present invention over prior art devices is that high compression forces are isolated from the plastic film tube until a fin seal is completely cured. A fin seal is faster to produce than a lap seal because heat can be driven into and removed from the plastic film from both sides of the film. Another key advantage is that the present invention is able to load stacks into a film tube in a continuous motion process at rates as high as 75 stacks per minute. This is because stacks are spaced apart in the cantilevered compression isolating device so that transverse tube sealing and cutting between stacks (not shown) may occur independently, downstream from the tube forming and filling operation.

There is a fine balance among the operating variables of the present invention: compression force required between pair of conveyor belts 14; the footprim of stacks of resilient articles on conveyor belts 60 and 62; the spacing of stacks, which is needed for transverse sealing; and the desired operating speed of apparatus 10. Compression force determines friction force between the belts and their backing members. Operating speed determines the number of stacks needed between the belts to enable a required compression isolation time for fin seals to cure. The number of stacks between the belts multiplies the friction force. The tension in the belts is a function of the friction force. The belts are designed to carry a high working tension while being thin enough to bend around the small diameter discharge pulleys, which are required to minimize the difference between pre-compressed stack dimension 40 and expanded stack dimension 42. The thin belts and small diameter discharge pulleys, the thin walled solid steel channel backing members, the low friction hard chrome plating on the channels, and the thin steel tie bars between channels are therefore optimally dimensioned in the design of the present invention.

In a particularly preferred embodiment of the present invention, construction of key elements is as follows: A horizontal stack of resiliently compressed diapers has 26 diapers in a side-by-side row, is 162 mm wide while being conveyed in the compression isolating device, and has height and length dimensions of 115 mm by 210 mm. When released into a film tube, the compressed width increases to 240 mm, where it exerts an expansion force R on the plastic film tube of about 25 pounds.

A plastic film tube is made of 0.04 mm thick by 673 mm wide laminated polypropylene and polyethylene film stock. The tube is formed into a substantially rectangular cross section, with a width of 216 mm and a height of 135 mm.

A pair of conveyor belts 60 and 62 each have a height of 108 mm, a spacing between closest sides of 162 mm, and a conveying length of 1.9 m, 1.4 m of which length is cantilevered. Each belt has a thickness of 1.5 mm and is made of polyester and urethane. Such belts are available from F. N. Sheppard Co. of Eftanger, Ky., as model no. 2W1-2E1. Each belt has a hot vulcanized finger splice and ground edges. The belts have a polyester core and a white urethane top coat. They are thin and flexible, yet strong, having a working tensile strength of 90 pounds per inch of width. Dynamic belt tensioners are provided because belt loading can vary greatly depending on how many stacks of resilient articles are being conveyed at a time. Belt tension is maintained high enough to assure that the belts never slacken.

An unwind system for a roll of plastic film is preferably centered over the cantilevered pair of conveyor belts. A folding board is located 1.33 mm upstream of the cantilevered end of the pair of conveyor belts. Film is fed continuously at substantially the same 25 meters per minute rate at which the stacks are fed. There is a spacing of approximately 140 mm between stacks. Drawing the film web from the unwind system is accomplished preferably by three pair of 114 mm diameter draw and heat and chill wheels. The sealing wheels are heated at 340° F. and the chill wheels maintained at 70° F. The resulting fin seal, that extends 13 mm outwardly from the tube, is produced under 10 pounds of force between wheels. The sealing is sufficiently complete to maintain the stack of resiliently compressed articles compressed in the longitudinally sealed tube after one second of cooling time after exiting the sealing wheels.

A frame made of steel tubing supports a first infeed pulley and a second infeed pulley, the first and second infeed pulleys being substantially parallel to each other. First and second backing members are steel channels connected to the frame. The backing members are 1.8 m long. Each channel has a 1.6 mm deep groove on the outside, for recessing a conveyor belt to prevent it rubbing against the film tube, and a 9.5 mm web cross-section thickness. Each channel is hard chrome plated to provide a low friction belt sliding surface. The kinetic coefficient of friction of hard chrome with the polyester inner belt surface is about 0.16. Other channel surface coatings may produce lower friction coefficients, but they are either much more expensive or are not as durable.

As many as 5 stacks of resiliently compressed articles are continuously conveyed at a time at about 25 meters per minute by a 5 hp belt drive motor.

First and second discharge pulleys are located at the cantilevered end of the pair of conveyor belts. Each discharge pulley has a length of 108 mm and a diameter of 9.5 mm, which is minimized to reduce the expansion of the stack of resiliently compressed articles after its release into the tube. At least one tie bar connects the first and second backing members near the first and second cantilevered ends to maintain the first and second backing members substantially parallel and rigid. A typical tie bar is 157 mm long×25 mm wide×1.5 mm thick and it is made of steel. Preferably, six or eight tie bars are used to resist the high compression force between conveyor belts.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A method of feeding a stack of resiliently compressed articles into a plastic film tube comprising the steps of:

a) receiving said stack of resiliently compressed articles into an infeed end of a pair of conveyor belts;

b) continuously conveying said stack of resiliently compressed articles to a discharge end of said pair of conveyor belts;

c) progressively forming a plastic film around said pair of conveyor belts to form a closed tube, wherein said stack of resiliently compressed articles exerts no expansion force on said closed tube while said stack of resiliently compressed articles is being conveyed by said pair of conveyor belts;

d) continuously sealing said closed tube to form a longitudinally sealed tube; and e) releasing said stack of resiliently compressed articles into said longitudinally sealed tube only after said sealing step is sufficiently complete to maintain said stack of resiliently compressed articles compressed in said longitudinally sealed tube.

2. The method of claim 1 further comprising the step of allowing said stack of resiliently compressed articles to expand to a dimension greater than a pre-compressed dimension when said stack of resiliently compressed articles is released into said longitudinally sealed tube.

3. The method of claim 1 wherein said progressively forming step generates substantially parallel outwardly-facing edges on said closed tube and said continuously sealing step seals provides sealing of said substantially parallel outwardly-facing edges to form a fin seal.

4. The method of claim 1 wherein said pair of conveyors is oriented to convey said stack of resiliently compressed articles horizontally compressed.

5. The method of claim 1 wherein said stack of resiliently compressed articles is maintained spaced apart from other stacks of resiliently compressed articles throughout said continuously conveying step.

6. The method of claim 1 wherein said stack of resiliently compressed articles, continuously conveyed by said pair of conveyors, is maintained compressed under a force of about 75 to about 200 pounds.

7. An apparatus for feeding a stack of resiliently compressed articles into a plastic film tube comprising:

a) a frame;

b) a first infeed pulley supported from said frame;

c) a second infeed pulley supported from said frame, said second infeed pulley being substantially parallel to said first infeed pulley;

d) a first backing member connected to said frame, said first conveyor backing member having a first cantilevered end and a first discharge pulley mounted to said first cantilevered end;

e) a second backing member connected to said frame, said second backing member having a second cantilevered end and a second discharge pulley mounted to said second cantilevered end, said second discharge pulley being substantially parallel to said first discharge pulley;

f) a first conveyor belt passing around said first infeed pulley and said first discharge pulley, said first backing member being supported within said first conveyor belt between said first infeed pulley and said first discharge pulley;

g) a second conveyor belt passing around said second infeed pulley and said second discharge pulley, said second backing member being supported within said second conveyor belt between said second infeed pulley and said second discharge pulley;

h) at least one tie bar connecting said first and second backing members near said first and second cantilevered ends to maintain said first and second backing members substantially parallel and rigid, said first and second backing members being spaced apart such that said stack of resiliently compressed articles is maintained compressed between said first and second conveyor belts when said first and second conveyor belts are backed up by said first and second backing members;

i) a drive system for driving at least one of said first and second conveyor belts such that said resiliently compressed articles are conveyed continuously from said first and second infeed pulleys to said first and second discharge pulleys, said first and second conveyor belts, said first and second backing members, and said at least one tie bar defining a compression isolating device;

j) a plastic film unwind system and a film tube former for progressively forming plastic film from said film unwind system into a closed plastic film tube around said compression isolating device;

k) means for continuously drawing said plastic film over said film tube former and sealing said dosed plastic film tube to form a longitudinally sealed tube, said sealing means located relative to said compression isolating device such that said stack of resiliently compressed articles are released from said compression isolating device into said longitudinally sealed tube only after said longitudinally sealed tube has sufficient strength to maintain said stack of resiliently compressed articles compressed.

8. The apparatus of claim 7 wherein said closed plastic film tube has substantially parallel outwardly-facing edges and said means for continuously sealing provides sealing of said substantially parallel outwardly-facing edges to form a fin seal.

9. The apparatus of claim 7 wherein said first and second conveyor belts are oriented to convey said stack of resiliently compressed articles horizontally compressed.

10. The apparatus of claim 7 wherein said stack of resiliently compressed articles is maintained spaced apart from other stacks of resiliently compressed articles while compressed between said first and second conveyor belts.

11. The apparatus of claim 7 wherein said stack of resiliently compressed articles is continuously conveyed by said first and second conveyor belts and while maintained compressed under a force of about 75 to about 200 pounds.

12. A method of feeding a stack of resiliently compressed articles into a plastic film tube comprising the steps of:

a) receiving said stack of resiliently compressed articles into an infeed end of a pair of conveyor belts, said stack of resiliently compressed articles being compressed horizontally between said pair of conveyor belts under a force of about 75 to about 200 pounds, said stack of resiliently compressed articles being spaced apart from other stacks of resiliently compressed articles;

b) continuously conveying said stack of resiliently compressed articles to a discharge end of said pair of conveyor belts, said force being substantially maintained throughout said continuously conveying step;

c) progressively forming and sealing a plastic film around said pair of conveyor belts to form a longitudinally sealed closed tube, wherein said stack of resiliently compressed articles exerts no expansion force on said longitudinally sealed closed tube while said stack of resiliently compressed articles is being conveyed by said pair of conveyor belts; and d) releasing said stack of resiliently compressed articles into said longitudinally sealed dosed tube only after sealing is sufficiently complete to maintain said stack of resiliently compressed articles compressed in said longitudinally sealed closed tube.

13. The method of claim 12 further comprising the step of allowing said stack of resiliently compressed articles to expand to a dimension greater than a pre-compressed dimension when said stack of resiliently compressed articles is released into said longitudinally sealed closed tube.

* * * * *